US009305471B1

(12) United States Patent
Braun et al.

(10) Patent No.: US 9,305,471 B1
(45) Date of Patent: Apr. 5, 2016

(54) DISPLAY FOR USE IN MANAGING A PATIENT

(71) Applicant: Safe Moves Injury Prevention Solutions Inc., West Kelowna (CA)

(72) Inventors: Matthew Peter Braun, Niverville (CA); Robin Lee Diduch, West Kelowna (CA); Guy Henry Daniel Woods, Winnipeg (CA)

(73) Assignee: Safe Moves Injury Prevention Solutions Inc., West Kelowna, BC (CA)

( * ) Notice: Subject to any disclaimer, the term of this patent is extended or adjusted under 35 U.S.C. 154(b) by 0 days.

(21) Appl. No.: 14/721,749

(22) Filed: May 26, 2015

(51) Int. Cl.
*G09F 7/10* (2006.01)
*G09F 11/00* (2006.01)

(52) U.S. Cl.
CPC ..... *G09F 11/00* (2013.01)

(58) Field of Classification Search
CPC ... G08B 21/02; G08B 21/245; G08B 21/0446
USPC ..... 40/491
See application file for complete search history.

(56) References Cited

U.S. PATENT DOCUMENTS 1,421,219 A * 6/1922 Harmon ..... G09F 3/202 206/216
1,796,398 A * 3/1931 Richardson ..... A61J 7/04 116/308
1,950,821 A * 3/1934 Sharpe ..... G04C 17/0016 40/118
2,223,917 A * 12/1940 McGloin ..... B42D 5/045 116/280
2,676,019 A * 4/1954 Steinberg ..... A63F 9/18 273/141 R
4,326,711 A * 4/1982 Giallombardo ..... A63F 5/04 273/142 HA
5,030,027 A * 7/1991 Bachrach ..... B42F 13/40 281/29
7,225,567 B1 * 6/2007 Cunningham ..... G09F 1/06 40/124.12
8,018,797 B2 * 9/2011 Wu ..... G04B 47/02 368/278
8,590,182 B2 * 11/2013 Federkevic ..... A01K 29/00 119/712
8,999,477 B2 * 4/2015 Hirth ..... G09F 3/0294 40/299.01
2001/0045037 A1 * 11/2001 Bank ..... G09F 7/04 40/621
2006/0225324 A1 * 10/2006 Culiver ..... G09F 11/23 40/493
2010/0199532 A1 * 8/2010 Blue ..... G09F 7/18 40/491
2012/0272553 A1 * 11/2012 Bell ..... G09F 15/00 40/611.07
2015/0206462 A1 * 7/2015 Blue ..... G09F 7/10 40/491

* cited by examiner

*Primary Examiner* — Shin Kim
(74) *Attorney, Agent, or Firm* — Adrian D. Battison; Ade & Company Inc

(57) ABSTRACT

A display system for use by a caregiver team in managing a patient includes a substrate panel arranged to be suspended on a wheelchair with a clock face printed on the front surface with at least one manually movable hand to display a selected time. A first window display on the front surface is manually set a selected time period to visit the patient. A plurality of alternate operations on the patient to reduce pressure issues is printed on the rear and a selected one is indicated to the caregiver by moving a marker so that the caregiver is required by the clock time on the clock face to attend the patient, to carry out the selected action and to reset the clock time by an increment determined by the time period and so that the failure to attend the patient is immediately visible.

21 Claims, 5 Drawing Sheets

CareClock
WILL RETURN
12
1
2
3
4
5
6
7
8
9
10
11
10
11
15
16
17
18
18A
19
20
21
22
23
24
25
12
35
36
37

CareClock
17
16
10
26D
26
26E
26B
26A
26F
33
13
29
27
31
ADDITIONAL INSTRUCTIONS
To bed after all meals
To bed after breakfast
To bed after lunch
At time of repositioning:
Perform toilet routine
Check for incontinence
Perform fall safety check
Restraint safety check
Other:
38
39
38A

DISPLAY FOR USE IN MANAGING A PATIENT

This invention relates to a display apparatus for use in managing a patient which may be particularly arranged for indicating to a care giver when a patient in a wheelchair should be moved.

Patients in wheelchairs are susceptible to pressure sores and should be moved periodically to alleviate the sores.

At these times of careful management of health care costs, it is desirable to provide to a caregiver team a simple display which clearly sets out the required actions and the time those actions required in respect of each patient and allows a clear visual indication when the caregiver has failed to attend.

SUMMARY OF THE INVENTION

According to one aspect of the invention there is provided a display apparatus for use by a caregiver team in managing a patient comprising:

a substrate panel having front and rear surfaces arranged to be mounted on a support for visual presentation to the care giver;

a clock face on the front surface of the substrate with at least one manually movable time indicator hand on the clock face so that the care giver can set the hand or hands to display a selected time;

a first manually operable visual display component on the front surface operable to set and display to the caregiver a selected time period;

a second visual display component arranged to display a plurality of tasks to be carried out on the patient;

the second visual display component being arranged for the caregiver to select a selected one of the plurality of tasks displayed and manually operable by the caregiver to display the selected one of the tasks to the caregiver;

whereby the caregiver is required by the display of the selected time to attend the patient at the selected time, to carry out the selected one of the tasks and to reset the selected time by an increment determined by the selected time period;

and whereby an immediate visual indication is provided by the selected time displayed if and when the caregiver has failed to attend the patient at the selected time displayed to carry out the selected one of the tasks.

Preferably the system is maintained very simple with minimum opportunity for error and to allow the caregiver to easily assess what is required. This can be done by providing to each patient an individual display attached to the wheelchair in which they sit where the time period for re-visiting is pre-set and remains unchanged and where the action to be taken is tailored to their physical condition and again remains unchanged. Even the least motivated care giver can easily therefore manage a number of patients while carrying out for each the stipulated repeated checks and actions at the time periods specified.

Preferably the first visual display component showing the time period is on the first surface of the substrate panel so as to be readily visible with the display clock showing the time.

In one arrangement the second visual display component can be on the front surface of the substrate panel optionally provided by a drop down panel on which is printed the actions which can be taken. In this arrangement the selected action is marked simply by hand marking the panel.

In addition or alternatively the second visual display component can be provided on the rear surface of the substrate panel where the plurality of tasks of the second visual display component are printed on the substrate panel and the selection is displayed by providing a marker at the selected printed task.

Preferably the marker is provided by moving a marker sheet on a circular disk relative to the substrate panel to move a mark on the marker sheet to a window to indicate or point to the selected task printed on the substrate panel. The task is preferably displayed by an icon or symbol illustrating the action concerned.

In addition preferably the marker sheet carries a plurality of printed readable instruction elements where each element relates to a respective one of the printed tasks and provides more detail beyond that shown in the icon. Thus preferably the substrate panel includes an instruction window at which a selected one of the printed readable instruction elements is displayed and the mark on the marker sheet is moved to the selected task when the respective printed readable instruction elements is located at the instruction window. This provides to the knowledgeable caregiver and immediate indication of the action to be taken and gives more information to less knowledgeable caregivers who need more detail.

For simplicity, the first manually operable visual display component on the front surface preferably comprises a window on the front surface and a plurality of set times printed on a time sheet which is movable relative to the substrate panel to locate a selected one of the selected time periods at the window.

To further assist the caregiver with additional actions that may be required, there is preferably printed on the rear surface of the substrate panel an additional area containing a series of printed instructions with a selection check box to be selected by the caregiver.

Preferably the tasks on the second visual display component relate to actions for the patient in a wheelchair to carry out periodically at the selected period to alleviate pressure from sitting in the wheelchair. For example the actions can comprise:

Leaning forward for a time period;

Leaning to each side for a time period;

Standing for a time period;

Walking for a time period;

Tilting the chair for a time period.

However other tasks can be provided as well as or instead of the above particularly where the display apparatus is to be used in a situation other than the wheelchair bound patient.

According to a second aspect of the invention there is provided a display apparatus for use by a caregiver team in managing a patient comprising:

a substrate panel having front and rear surfaces arranged to be mounted on a support for visual presentation to the care giver;

a visual display component arranged to display a plurality of tasks to be carried out on the patient;

the visual display component being arranged for the caregiver to select a selected one of the plurality of tasks displayed and manually operable by the caregiver to display the selected one of the tasks to the caregiver;

wherein the plurality of tasks of the visual display component are printed on the substrate panel and the selection is displayed by providing a marker at the selected printed task;

wherein the marker is provided by moving a marker sheet relative to the substrate panel to move a mark on the marker sheet to indicate the selected task printed on the substrate panel;

wherein the marker sheet carries a plurality of printed readable instruction elements where each element relates to a respective one of the printed tasks;

and wherein the substrate panel includes an instruction window at which a selected one of the printed readable instruction elements is displayed and wherein the mark on the marker sheet is moved to the selected task when the respective printed readable instruction elements is located at the instruction window.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

The display apparatus shown in the Figures is arranged for use by a caregiver team in managing a patient. Thus each member of a team responsible for a group of patients, including a supervisor, can review the display of each of the group to immediately ascertain the status of the periodic care required to be applied to the patients for the purpose of keeping the periodic care up to date and for the purpose of assessing quickly and easily if the required care is not being maintained.

Figure 5:
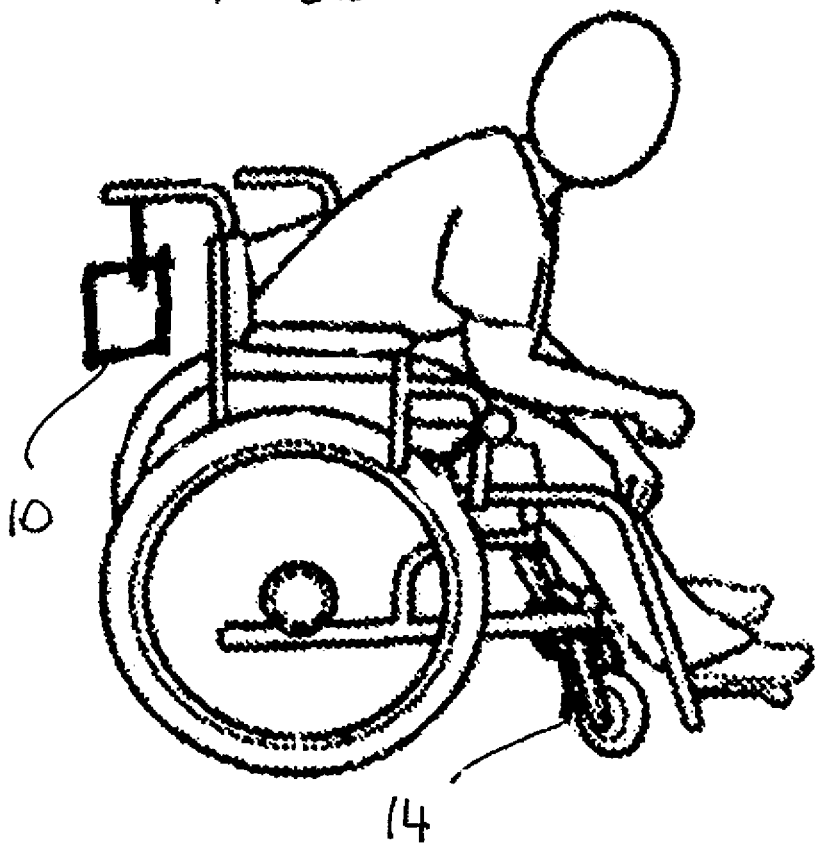
FIG. 5 is a schematic illustration of the apparatus of FIG. 1 attached to a rear of a wheelchair so that the apparatus remains with the wheelchair to be associated with the patient in the wheelchair regardless of where they move.

The apparatus 10 includes a substrate panel 11 having front and rear surfaces 12, 13 and arranged to be mounted on a support such as the rear of a wheelchair 14 as shown in FIG. 5 for visual presentation to the care giver. The panel is formed of two overlying sheets connected by pins at the center and at the hole 17.

The planar panel is generally circular with a circular peripheral edge 15 which is extended outwardly to form a lobe 16 at the top with a hole 17 by which the planar panel can be suspended on the wheel chair or at another location.

The circular front surface defines a clock face 18 with numbers 18A and manually movable time indicator hands 19 and 20 on the clock face 18 so that the care giver can set the hands by simply moving them around a center to display a selected time. There is no drive to the clock hands so that they remain stationary when manually set.

The front surface includes a window 21 which provides a visual display component on the front surface which is operable to set and display to the caregiver a selected time period indicated at 24. This is operated by marking the available time periods on a wheel 23 which can be rotated around a pin 25 to display a selected one of the time periods in the window. The intention is that when set for this patient and the patient's medical condition, the period remains set and this period is used for all future scheduled visits. The time period can be set to take into account the medical condition of the patient and also the availability of staff to carry out the visits. The time period can be re-set if the situation changes, for example if the time period cannot be met due to lower staff levels at certain times. The front face carries the statement "WILL RETURN" in respect of the indicated time so that the patient is so aware of the time that the next visit is scheduled.

While shown conveniently at the bottom of the front face adjacent the clock number 6, the display window 21 on the front of the clock can be positioned at another location on the front side of the clock so that it is spaced from the significant clock numbers to avoid a situation where the long hand of the clock covers the window from view.

On the rear face 13 is provided a second visual display component 26 arranged to display a plurality of tasks or actions which can be carried out on the patient depending on the patient's medical condition.

Figure 3:
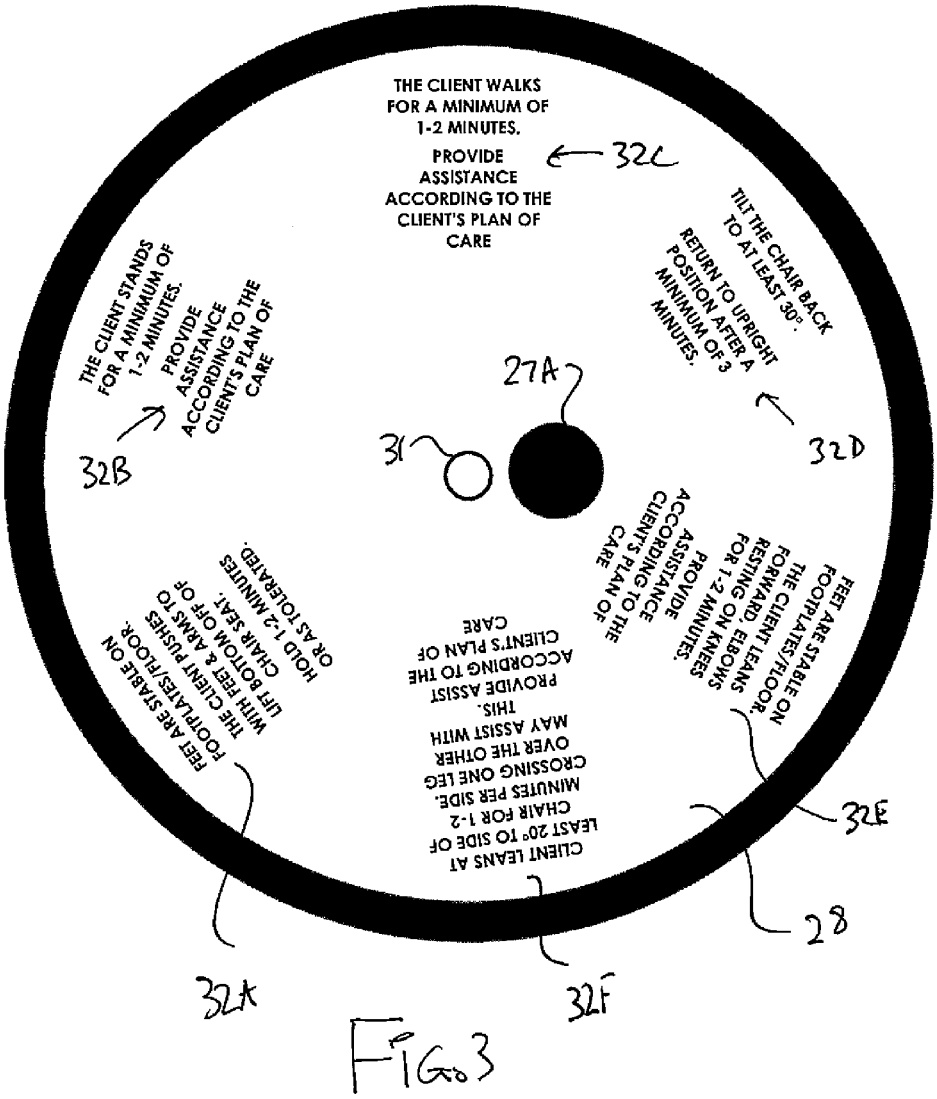
FIG. 3 is a front elevational view of a the front face of the rotatable marker sheet showing the marker which appears in the respective window of the rear surface of FIG. 2 and showing the instructions associated with the icons.

The actions 26A to 26F of the second visual display component are printed on the substrate panel so as to remain fixed in position on the rear surface 13 and the selection is displayed by providing a marker 27 at the selected printed task. As shown the marker is indicating task 26F The marker 27 is provided by a marker sheet 28 shown in FIG. 3 and mounted behind the rear surface, that is between the front sheet and the rear sheet so that a surface of the marker sheet is presented at windows in the rear surface 13. The marker sheet is movable relative to the rear sheet by rotation around the center pin 31. This moves the marker sheet 28 relative to the substrate panel 11 to move a mark 27A on the marker sheet 28 through different ones of a plurality of windows 29 on the rear surface 13 to indicate the selected task from the plurality of tasks printed on the substrate panel.

The marker sheet 28 also carries a plurality of printed readable instruction elements 32A to 32E where each element relates to a respective one of the printed tasks shown as icons at 26A to 26E. The rear surface of the substrate panel includes an instruction window 33 at which a selected one of the printed readable instruction elements 32A to 32E is displayed. The mark 27A on the marker sheet 28 is moved to the selected task, printed as an icon on the rear surface, when the respective printed readable instruction elements is located at the instruction window 33.

Thus the second visual display component, as defined by the icons 26A to 26E, the marker 27 and the instructions 32A to 32F, is arranged for the caregiver to select one of the plurality of tasks displayed and is manually operable by the caregiver to display the selected task to the caregiver. The intention is that when set for this patient and the patient's medical condition, the action remains set and this action is used for all future scheduled visits.

Briefly as shown the actions comprise:

Leaning forward for a time period;

Leaning to each side for a time period;

Standing for a time period;

Walking for a time period;

Tilting the chair for a time period.

The icons are intended to briefly show the action required to a knowledgeable caregiver. Further details are shown in the instructions on the marker sheet which read as follows:

32A

Feet are stable on footplates/floor. The client pushes with feet & arms to lift bottom off of chair seat. Hold 1-2 minutes or as tolerated.

32B

The client stands for a minimum of 1-2 minutes. Provide assistance according to the client's plan of care.

32C

The client walks for a minimum of 1-2 minutes. Provide assistance according to the client's plan of care.

32D

Tilt the chair back to at least 30 degrees. Return to upright position after a minimum of 3 minutes.

32E

Feet are stable on footplates/floor. The client leans forward, elbows resting on knees for 1-2 minutes. Provide assistance according to the client's plan of care.

32F

Client leans at least 20 degrees to side of chair for 1-2 minutes per side. Crossing one leg over the other may assist with this. Provide assist according to the client's plan of care.

Thus the apparatus is arranged and operated in a method in which the caregiver is required by the display of the selected time to attend the patient at the selected time, to carry out the selected one of the actions marked and to reset the selected time by an increment determined by the selected time period.

It will be apparent that an immediate visual indication is provided by the fact that the selected time displayed is past if and when the caregiver has failed to attend the patient at the stated time displayed to carry out the stated one of the actions. If this situation is found, it can be immediately remedied. If it is found by a supervisor, suitable management action can be taken.

Figure 1:
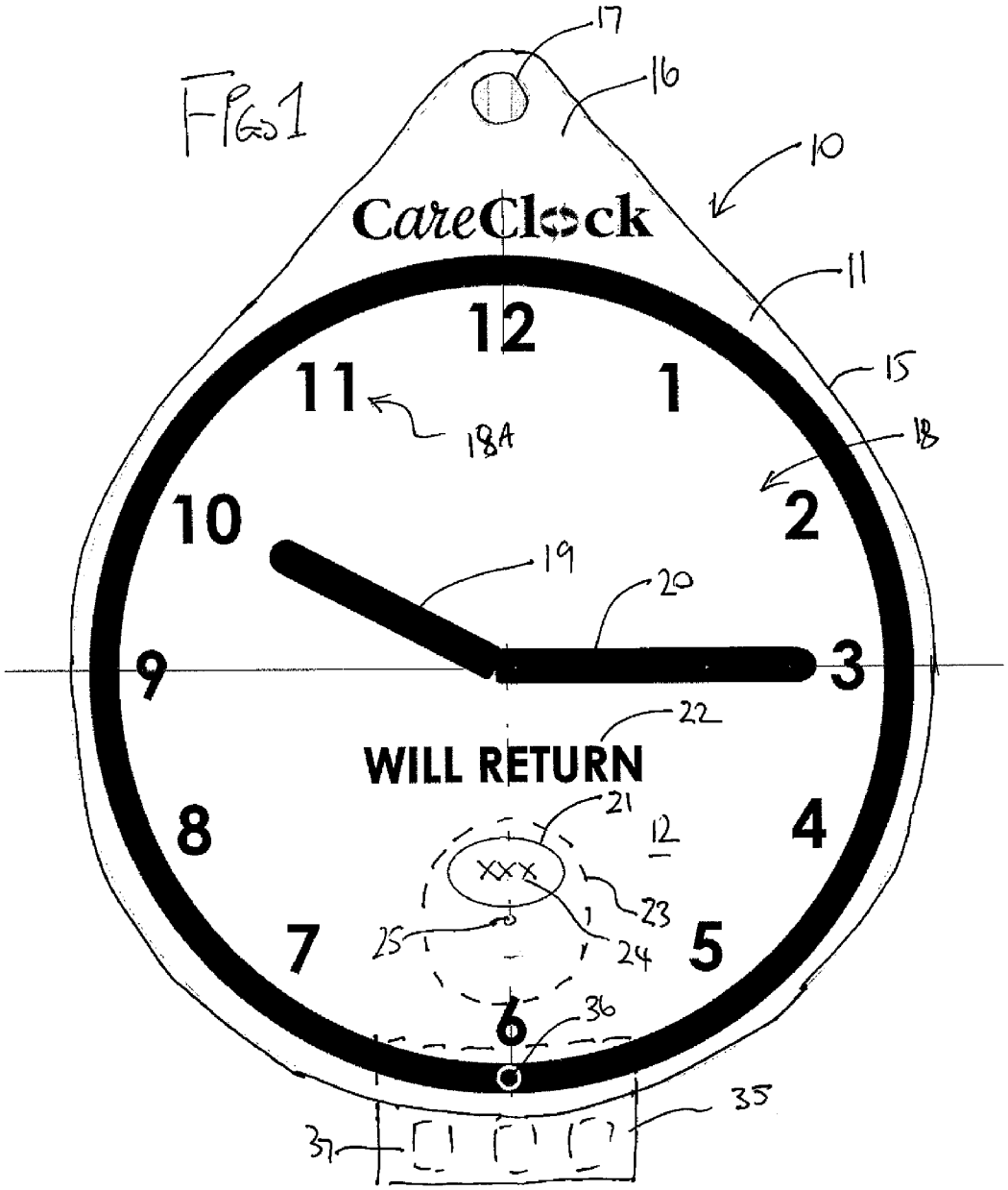
FIG. 1 is a front elevational view of a display apparatus according to the present invention.
Figure 4:
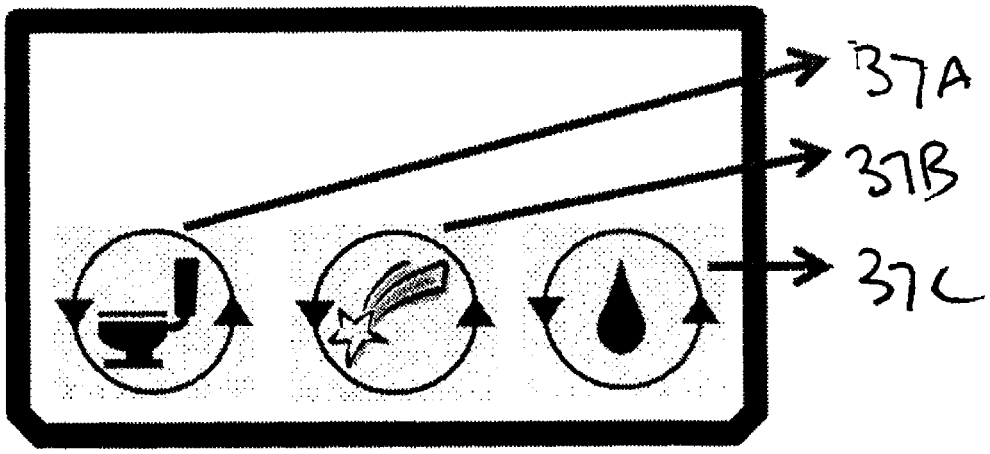
FIG. 4 is a front elevational view of the dropdown panel of FIG. 1.

In FIG. 1 there is provided a second section to the second visual display component which includes a drop down panel mounted on a pin 36 for movement on the substrate panel so that it can be moved to a raised retracted position and pivoted downwardly to show icons 37. Thus in this arrangement the second visual display component is on the front surface of the substrate panel. The icons 37A, 37B and 37C are shown in FIG. 4 and relate respectively to an instruction or task to the caregiver to check a toileting requirement, to check a possibility of a fall and to check an incontinence possibility. These tasks are marked for action in respect of the patient concerned not by a marker system as described above but instead by simply the relevant person marking those of the tasks to be performed by a visual mark.

Figure 2:
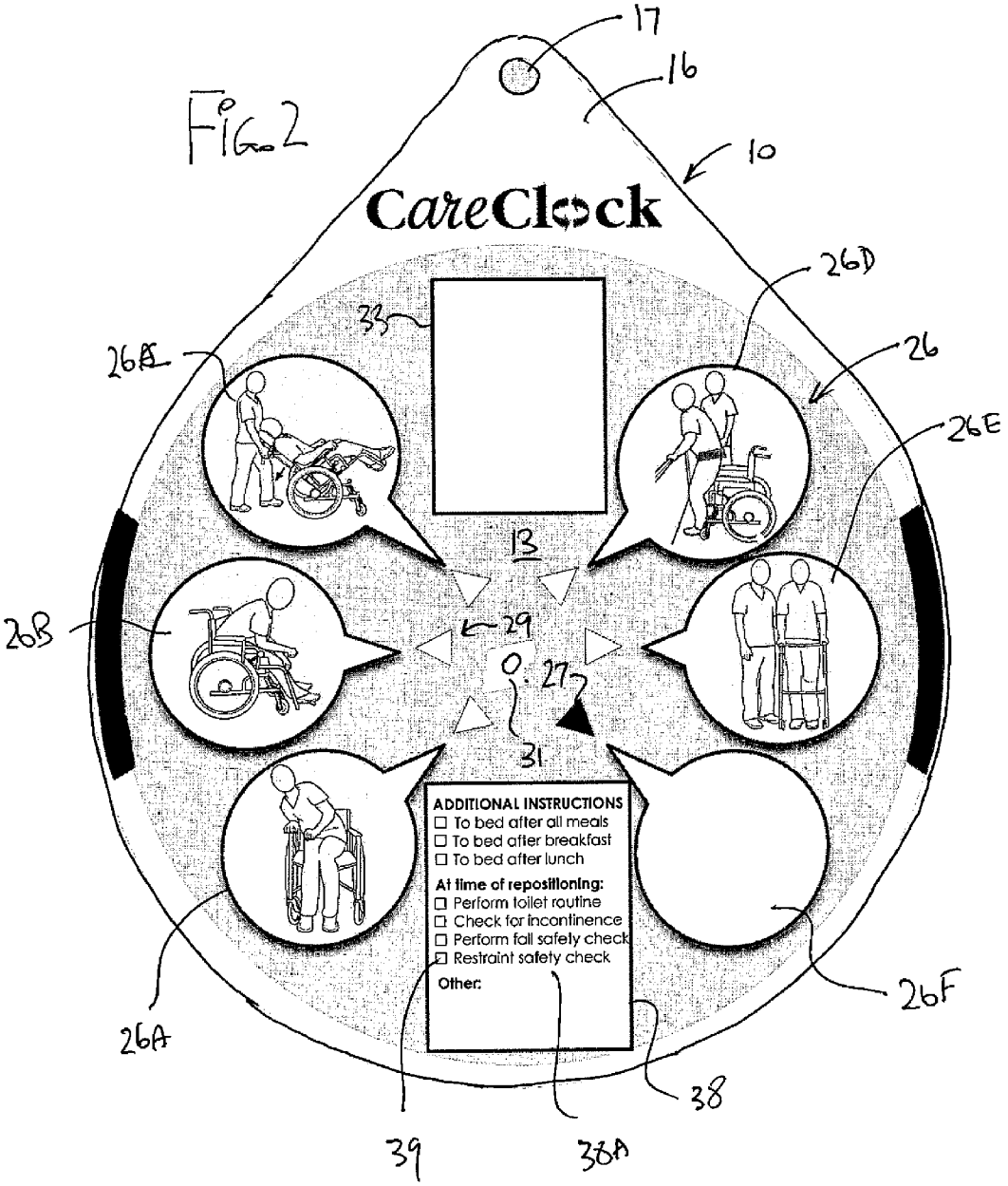
FIG. 2 is a front elevational view of the display apparatus of FIG. 1.

As shown in FIG. 2, there is printed on the rear surface 13 of the substrate panel 11 an additional area 38 containing a series of printed instructions 38A with a selection check box 39 to be selected by the caregiver. Possible instructions are as follows:

Additional instructions:
To bed after all meals
To bed after breakfast
To bed after lunch
At time of repositioning:
Perform toilet routine
Check for incontinence
Perform fall safety check
Restraint safety check

The invention claimed is:

1. A display apparatus for use by a caregiver team in managing a patient comprising:

a substrate panel having front and rear surfaces arranged to be mounted on a support for visual presentation to the care giver;

a clock face on the front surface of the substrate with at least one manually movable time indicator hand on the clock face so that the care giver can set said at least one hand to display a selected time;

a first manually operable visual display component on the front surface operable to set and display to the caregiver a selected time period;

a second visual display component arranged to display a plurality of tasks to be carried out on the patient;

the second visual display component being arranged for the caregiver to select a selected one of the plurality of tasks displayed and manually operable by the caregiver to display said selected one of the tasks to the caregiver;

whereby the caregiver is required by the display of the selected time to attend the patient at the selected time, to carry out the selected one of the tasks and to reset the selected time by an increment determined by the selected time period;

and whereby an immediate visual indication is provided by the selected time displayed if and when the caregiver has failed to attend the patient at the selected time displayed to carry out the selected one of the tasks.

2. The display apparatus according to claim 1 wherein the first visual display component is on the first surface of the substrate panel.

3. The display apparatus according to claim 1 wherein the second visual display component is on the front surface of the substrate panel.

4. The display apparatus according to claim 1 wherein the second visual display component is on the rear surface of the substrate panel.

5. The display apparatus according to claim 1 wherein the plurality of tasks of the second visual display component are printed on the substrate panel and the selection is displayed by providing a marker at the selected printed task.

6. The display apparatus according to claim 5 wherein the marker is provided by manually marking a mark on the substrate panel.

7. The display apparatus according to claim 5 wherein the marker is provided by moving a marker sheet relative to the substrate panel to move a mark on the marker sheet to indicate the selected task printed on the substrate panel.

8. The display apparatus according to claim 1 wherein the marker sheet carries a plurality of printed readable instruction elements where each element relates to a respective one of the printed tasks.

9. The display apparatus according to claim 1 wherein the substrate panel includes an instruction window at which a selected one of the printed readable instruction elements is displayed and wherein the mark on the marker sheet is moved to the selected task when the respective printed readable instruction elements is located at the instruction window.

10. The display apparatus according to claim 7 wherein the marker sheet comprises a wheel which is rotated relative to the substrate panel.

11. The display apparatus according to claim 7 wherein the marker sheet and the printed tasks are provided at the rear surface of the substrate panel.

12. The display apparatus according to claim 1 wherein the first manually operable visual display component on the front surface comprises a period window on the front surface and a plurality of set times printed on a time sheet which is movable relative to the substrate panel to locate a selected one of said selected time periods at said period window.

13. The display apparatus according to claim 1 wherein there is printed on the rear surface of the substrate panel an additional area containing a series of printed instructions with a selection check box to be selected by the caregiver.

14. The display apparatus according to claim 1 wherein the second visual display component includes a drop down panel mounted for movement on the substrate panel.

15. The display apparatus according to claim 1 wherein said tasks on the second visual display component relate to actions for the patient in a wheelchair to carry out periodically at said selected period to alleviate pressure from sitting in the wheelchair.

16. The display apparatus according to claim 15 wherein the actions comprise:

Leaning forward for a time period;
Leaning to each side for a time period;
Standing for a time period;
Walking for a time period;
Tilting the chair for a time period.

17. A display apparatus for use by a caregiver team in managing a patient comprising:

a substrate panel having front and rear surfaces arranged to be mounted on a support for visual presentation to the care giver;

a visual display component arranged to display a plurality of tasks to be carried out on the patient;

the visual display component being arranged for the caregiver to select a selected one of the plurality of tasks displayed and manually operable by the caregiver to display said selected one of the tasks to the caregiver;

wherein the plurality of tasks of the visual display component are printed on the substrate panel and the selection is displayed by providing a marker at the selected printed task;

wherein the marker is provided by moving a marker sheet relative to the substrate panel to move a mark on the marker sheet to indicate the selected task printed on the substrate panel;

wherein the marker sheet carries a plurality of printed readable instruction elements where each element relates to a respective one of the printed tasks;

and wherein the substrate panel includes an instruction window at which a selected one of the printed readable instruction elements is displayed and wherein the mark on the marker sheet is moved to the selected task when the respective printed readable instruction elements is located at the instruction window.

18. The display apparatus according to claim 17 wherein the marker sheet comprises a wheel which is rotated relative to the substrate panel.

19. The display apparatus according to claim 17 wherein the marker sheet and the printed tasks are provided at the rear surface of the substrate panel.

20. The display apparatus according to claim 17 wherein said tasks on the second visual display component relate to actions for the patient in a wheelchair to carry out periodically at said selected period to alleviate pressure from sitting in the wheelchair.

21. The display apparatus according to claim 20 wherein the actions comprise:

Leaning forward for a time period;
Leaning to each side for a time period;
Standing for a time period;
Walking for a time period;
Tilting the chair for a time period.

* * * * *